United States Patent [19]

Lehman et al.

[11] Patent Number: 4,488,767

[45] Date of Patent: Dec. 18, 1984

[54] REJECTION TYPE FUSE HOLDER

[75] Inventors: Lewis M. Lehman, Brown Deer; Joseph J. Gribble, Milwaukee, both of Wis.

[73] Assignee: Square D Company, Palatine, Ill.

[21] Appl. No.: 491,497

[22] Filed: May 4, 1983

Related U.S. Application Data

[63] Continuation of Ser. No. 244,449, Mar. 16, 1981, abandoned.

[51] Int. Cl.[3] ..... H01R 19/48

[52] U.S. Cl. ..... 339/91 R; 337/213; 337/225; 339/147 R

[58] Field of Search ..... 339/147 R, 147 P, 184 R, 339/186 R, 91 R; 337/194, 213, 216, 225–228, 231, 247

[56] References Cited

U.S. PATENT DOCUMENTS

| | | | |
|---|---|---|---|
| 2,907,849 | 10/1959 | Kobryner | 337/225 |
| 2,943,295 | 6/1960 | Stewart | 337/226 |
| 3,202,788 | 8/1965 | George | 337/215 |
| 3,358,100 | 12/1967 | Schleicher | 337/245 |
| 3,418,615 | 12/1968 | Canney | 337/194 |
| 3,585,558 | 6/1971 | Swain | 337/226 |
| 3,588,775 | 6/1971 | Poehlman, Jr. | 337/226 |
| 3,732,516 | 5/1973 | Puetz | 337/194 |
| 4,081,779 | 3/1978 | Ranzanigo | 337/226 |
| 4,097,114 | 6/1978 | Motten, Jr. | 337/226 |

FOREIGN PATENT DOCUMENTS

| | | | |
|---|---|---|---|
| 826986 | 1/1960 | United Kingdom | 339/186 R |

*Primary Examiner*—Neil Abrams
*Attorney, Agent, or Firm*—William H. Schmeling; Richard T. Guttman

[57] ABSTRACT

An improved fuse holder system which incorporates a rejection feature in the fuse holder, as well as its receptacle. The fuse holder and receptacle are arranged to reject standard fuses, as well as rejection type fuses, having a lower interrupt rating as may be used in control circuits of contactors and starters.

8 Claims, 10 Drawing Figures

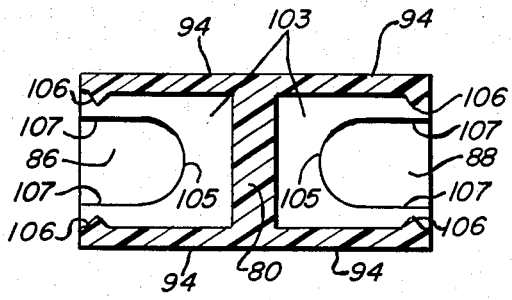
FIG. 4
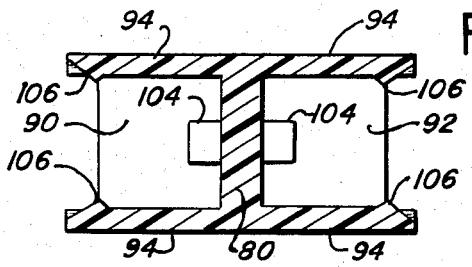
FIG. 5
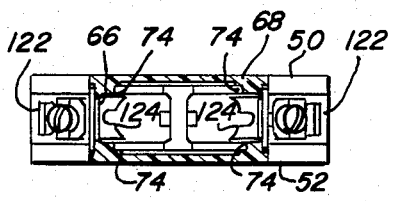
FIG. 6
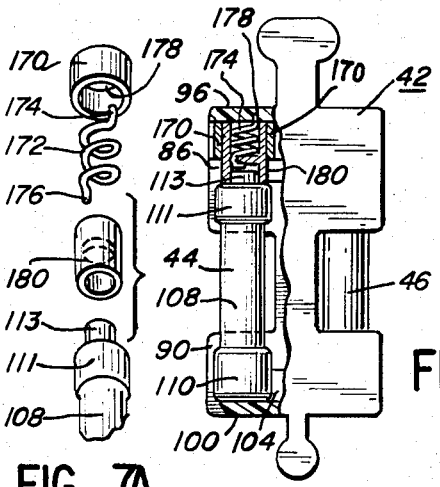
FIG. 7
FIG. 7A
FIG. 8
PRIOR
ART
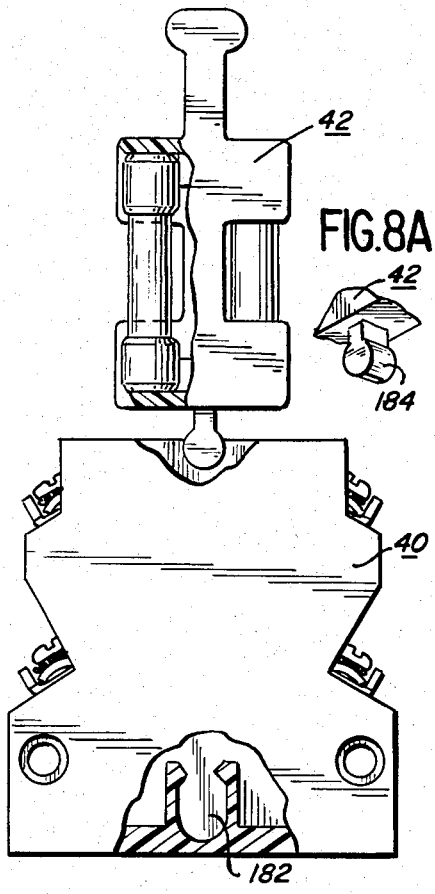
FIG.8A

REJECTION TYPE FUSE HOLDER

This is a continuation of the application Ser. No. 244,449 filed Mar. 16, 1981 now abandoned.

BACKGROUND OF INVENTION

Electromagnetic devices known as contactors and starters are frequently connected in control circuits and are used in circuits known as branch circuits to control the energization of an electric load, such as an electric motor. Various code requirements dictate that these branch circuits, as well as the control circuit, be protected by overcurrent devices which will interrupt the circuit whenever an excess current flows through the circuit. These overcurrent devices may include fuses, circuit breakers, or both.

Fuse holders which are suitable for incorporation into such branch or control circuits are well known. An illustration of one such fuse holder that is particularly suited for use in control circuits is disclosed in U.S. Pat. No. 3,732,516, which was granted on May 8, 1973, to Jordan S. Puetz and assigned to the assignee of the present invention. Such fuse holders as disclosed in the Puetz patent were designed to accept lower ampere rated fuses, such as standard 600-volt, 6-amp maximum fuses having standardized physical dimensions.

As the available current supply to electric utilization installations is constantly increasing, it is required that fuse manufacturers develop control circuit fuses which are capable of interrupting higher currents, e.g., 200,000 amperes. To meet this requirement, fuse manufacturers are offering fuses which have the same physical dimensions as other standardized control circuit fuses with a much lower interrupt rating. Thus, to a degree, standard rated fuses and fuses having higher interrupting capability are interchangeable. This interchangeability feature was convenient for users, but created other problems. A user who had a need for a fuse capable of interrupting 200,000 amperes could not be sure that a fuse which was incapable of interrupting 200,000 amperes could not be substituted. Fuse manufacturers currently are producing fuses with a 200,000 ampere interrupt rating which incorporate a rejection feature.

SUMMARY OF THE INVENTION

It is an object of the present invention to provide an improved fuse holder system which will accept ferrule-type fuses which have a rejection feature and reject other similar fuses having a lower interrupting rating.

Another object is to provide a fuse holder system which precludes a user's substitution of a fuse holder from a fuse holder assembly which does not incorporate a feature necessary to ensure exclusive acceptance of fuses with a rejection feature.

Further objects and features of the invention will be readily apparent to those skilled in the art from the following specification and from the appended drawings illustrating certain preferred embodiments, in which:

DESCRIPTION OF THE DRAWINGS

FIG. 4 is a view taken along line 4—4 in FIG. 1 with the fuses removed from the fuse holder and illustrating a means on the fuse holder for accommodating a rejection feature of a fuse;

FIG. 5 is a view taken along line 5—5 in FIG. 1 with the fuses removed from the assembly;

FIG. 6 is a view taken along line 6—6 in FIG. 1;

FIG. 7 is a view of an alternative embodiment of the fuse holder in FIG. 1;

FIG. 7A is a detailed exploded view of the means on the fuse holder for positioning a fuse in the alternative embodiment in FIG. 7;

FIG. 8 is a view of the prior art relating to this invention; and,

FIG. 8A is a perspective view of a portion of the rear end of the fuse holder in FIG. 8 showing in detail a projection for positioning the fuse holder within the socket of the receptacle.

DESCRIPTION OF THE PREFERRED EMBODIMENT

Figure 1:
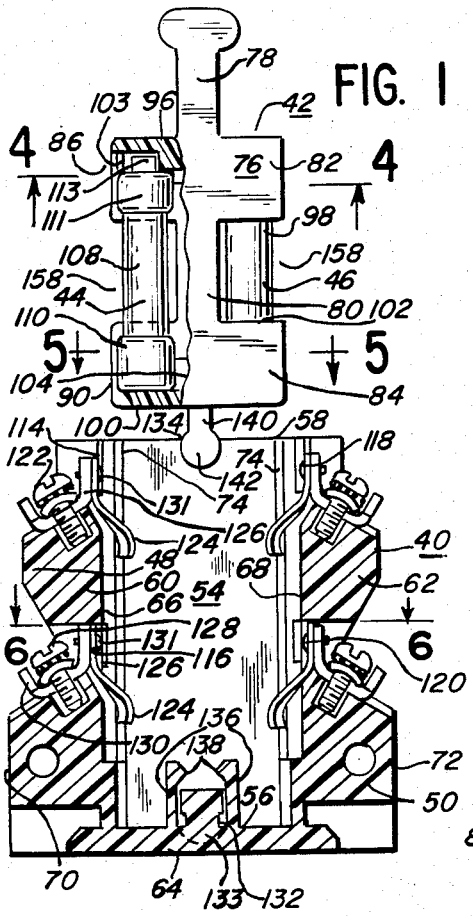
FIG. 1 is a view of a fuse holder system with a fuse holder detached from a fuse holder receptacle and showing the receptacle in section and portions of the holder broken away to illustrate structure on the holder positioning a rejection type fuse.

In the drawings, a fuse holder system 10 includes a receptacle 40 and a removable fuse holder 42 for releasably positioning a pair of fuses 44 and 46 in the receptacle 40. The receptacle 40 includes a housing 48 which is formed of a pair of molded insulating parts 50 and 52 to provide a substantially rectangular socket 54. In the preferred embodiment, the parts 50 and 52 are molded of transparent material so the fuses 44 and 46 are visible externally of the housing 48. The housing 48 has a rear wall 56, which provides the socket 54 with a substantially closed rear end 64 and is formed so the socket 54 has an open front end 58, which provides an entry way for the fuse holder 42. A pair of sidewalls 60 and 62, extending from the front end 58 to the rear end 64, provide the socket with a pair of confronting sidewalls 66 and 68 and the housing 48 with a pair oppositely facing external walls 70 and 72. Extending from front to rear at each of the four corners of the socket 54 is a guide rib 74, as shown in FIG. 6, which serves to guide and position the fuse holder 42 within the socket 54.

The fuse holder 42 is formed as a unitary body of molded insulating material to have a body portion 76 and a finger grip portion 78. The finger grip portion 78 extends forwardly from the body portion 76 and is externally accessible of the front end 58 when the body portion 76 is positioned within the socket 54. The finger grip portion 78 is provided so that a manual force applied to the finger grip portion 78 along an axis normal to the rear end 64 will cause the body portion 76 to be removed from the socket 54.

The body portion 76 is substantially rectangular in shape and includes a stem portion 80 and an arm portion 82 at a forward end of the stem portion 80 and an arm portion 84 at a rearward end of the stem portion 80. The arm portion 82 extends from opposite sides of the stem portion 80 to provide a pair of rearwardly facing recesses 86 and 88 on opposite sides of the stem portion 80 at the front end of the body portion 76, as shown in FIG. 4. Similarly, the arm portion 84 extends from opposite sides of the stem portion 80 to form a pair of forwardly facing recesses 90 and 92 on opposite sides of the stem portion at the rear end of the body portion 76, as shown in FIG. 5. Each of the recesses 86, 88, 90 and 92 includes a pair of sidewalls 94 which are capable of being flexed.

The recesses 86 and 88 have a wall 96 closing their upper ends and an open bottom side 98, as illustrated by FIG. 1. The recesses 90 and 92 have a wall 100 closing their lower ends and an open upper side 102. Projecting into each of the recesses 90 and 92 is an individual abutment 104. Extending into each recess 86, 88, 90 and 92 from each of their associated sidewalls 94 is a nib 106. Affixed within each of the recesses 86 and 88 and integral with their associated walls 96 is a U-shaped cradle 103. The cradles 103 are positioned within the recesses 86 and 88 so that their rounded bight portions 105 abut the stem portion 80 and their arms 107 face outwardly from the stem portion 80 and abut the sidewalls 94.

The recesses 86, 88, 90 and 92 on the fuse holder 42 cooperate and are constructed to position the fuses 44 and 46 within the socket 54. The fuses 44 and 46 are identical and are of the cartridge type with a rejection feature. Each of the fuses has a cylindrical body 108, a cylindrical terminal 110 at one end of the body 108 forming a cylindrical extension of the body 108 and extending along the axis of the cylindrical body 108 and a shorter cylindrical terminal 111 at the other end of the body 108 which forms a cylindrical extension of the body 108. The terminal 111 extends along the axis of the cylindrical body 108 and has a turricular rejection post 113 at its end most distal from the body 108 which extends along the axis of the cylindrical body 108. The fuse 44 is installed in the recesses 86 and 90 by passing the fuse 44 through an opening between the sidewalls 94 of the associated recesses 86 and 90 to a position wherein the terminal 110 at one end of the fuse 44 is positioned against abutment 104 in the recess 90 and the turricular rejection post 113 of the terminal 111 is positioned within the cradle 103 in recess 86. During the passage of the terminals 110 and 111 to their respective positions within the recesses 90 and 86, the sidewalls 94 of the associated recesses flex to permit the terminals 110 and 111 to pass over the nibs 106. When the terminals 110 and 111 are positioned respectively on the abutment 104 and within the cradle 103, the nibs 106 will engage surface portions on the terminals 110 and 111 to resiliently maintain the fuse 44 in its proper position within fuse holder 42. The walls 96 and 100 of the recesses 86 and 90, respectively, are provided to engage the free ends on the terminal 110 and the turricular rejection post 113 of the terminal 111 and prevent the fuse 44 from being axially displaced in the fuse holder 42. Similarly, the fuse 46 is installed in the recesses 88 and 92 by passing the terminals 110 and 111 on the fuse 46 through the opening between the sidewalls 94 of the associated recesses 88 and 92 to a position wherein the terminals 110 and 111 of the fuse 46 are positioned respectively against the abutment 104 and within the cradle 103 in the associated recesses 92 and 88. During the passage of terminals 110 and 111 on the fuse 46 to its position within the recesses 92 and 88, the walls 94 of the associated recesses 92 and 88 will flex to permit the terminals 110 and 111 to pass over the nibs 106. When the terminals 110 and 111 are positioned respectively against the abutment 104 and within the cradle 103, the nibs 106 will engage surface portions on the terminals 110 and 111 to resiliently maintain fuse 46 in its proper position within the fuse holder 42. The walls 96 and 100 of the recesses 88 and 92, respectively, are provided to engage the free ends on the turricular rejection post 113 of the terminal 111 and the terminal 110 and prevent the fuse 46 from being axially displaced in the fuse holder 42.

The fuse holder 42, when positioned in the socket 54, will position the fuses 44 and 46 so that the terminals 110 and 111 on the fuse 44 will have a surface exposed and facing the sidewall 66 and surface portions on the terminals 110 and 111 on the fuse 46 will be exposed and face the sidewall 68 with the terminals 110 and 111 on the opposite ends of fuses 44 and 46 positioned respectively at the rear and the front portions of the socket 54.

The receptacle 40 includes a first pair of terminal assemblies 114 and 116, which are positioned by the wall 66 so that the terminal assembly 114 is located adjacent the front end 58 of the socket 54 and the terminal assembly 116 is located adjacent the rear end 64 of the socket 54. The receptacle 40 also includes a second pair of terminal assemblies 118 and 120, which are positioned by the wall 68 so that the terminal assemblies 118 and 120 are respectively located adjacent the front and rear ends 58 and 64 of the socket 54. The four terminal assemblies 114, 116, 118 and 120 are identical and each includes a wire connecting terminal 122, located externally of one of the walls 60 and 62 and a pair of spaced contacts 124, which are resilient and electrically connected to their associated wire connecting terminal 122 and extend from one of the sidewalls 66 or 68 into the socket 54 in positions where the spaced contacts 124 tightly engage one of the terminals 110 or 111 when the fuse holder is positioned in the socket 54. The wire connecting terminals 122 each include a strap 126 that has a threaded opening at one end which receives a terminal screw 128. The screw 128 positions a wire clamp 130. The contacts 124 are secured to a portion of the strap 126 by a rivet 131 and are contoured, as shown in FIG. 6, to have a maximum area surface engagement with the terminals 110 and 111.

The preferred embodiment of the fuse holder assembly also includes a cavity 132 at the rear end 64 of the socket 54, a rejection plug 133 centrally fixed within the cavity 132 such that space remains on each side between the rejection plug 133 and the two molded insulating parts 50 and 52, and a pair of spaced projections 134 at the rear end of the fuse holder 42 for maintaining the fuse holder 42 in its fully inserted position within the socket 54.

The cavity 132 is formed by a pair of spaced, slightly resilient walls 136 that extend forwardly from the rear wall 56. The walls 136 have lips 138 at their forward ends which reduce the width of the cavity 132 at its forward end. The paired projections 134 have necked portions 140 from which bulged ends 142 extend. The bulged ends 142 have a width slightly greater than the space between the lips 138 and are sized to be received in the portion of the cavity 132 spaced rearwardly of the lips 138 and astride the rejection plug 133. The necked portions 140 have a width less than the space between the lips 138.

The fuse holder 42, when fully inserted into the socket 54, will cause the bulged ends 142 to be received in the cavity 132 astride the rejection plug 133 and each of the terminals 110 and 111 on the fuses 44 and 46 to be engaged by the contacts 124 on one of the terminal assemblies 114, 116, 118 and 120. Thus, the fuse 44 will complete a fused circuit between the terminal assemblies 114 and 116 and the fuse 46 will complete a fused circuit between the terminal assemblies 118 and 120. The fuse holder 42 will be resiliently maintained in its position in the socket 54 by the detachable connection between the projections 134 and the cavity 132. In the preferred embodiment, the terminal assemblies 114, 116, 118 and 120 are positioned by the sidewalls 66 and 68, and the cavity 132 and the projections 134 are sized and shaped so that the terminals 110 and 111 are not engaged by the contacts 124 when the maximum width portions of the bulged ends 142 are positioned forwardly of the lips 138. Further, the parts are sized and arranged so that, as the maximum width portions of the bulged ends 142 pass rearwardly of the lips 138, the resilient walls 136 will cause the bulged ends 142 to move fully into the cavity 132 and position the fuse holder 42 at its fully inserted position within the socket 54.

While the preferred embodiment of the fuse holder assembly is shown as having two fuses, if it is desired to fuse only one side of a circuit, one of the fuses can be eliminated from the fuse assembly and the remaining fuse connected in a series circuit as desired.

Replacement of the fuses 44 or 46, or both, may be readily accomplished while the control circuit is electrically connected to a supply by using the insulating finger grip portion 78 to remove the fuse holder 42 from the receptacle 40. The removal of the fuses 44 or 46, or both, from the fuse holder 42 can be accomplished without tools because of the spaces 158 provided between the spaced arms 82 and 84 on opposite sides of the stem 80 which permit access to the body 108 of the fuses 44 and 46 and permit the fuse to be externally visible from the exterior of the fuse holder assembly.

An alternative embodiment of the fuse holder 42 is shown in FIG. 7. In this alternative embodiment, the structure of the recesses 90 and 92 with their associated abutments 104 and wall 100 is the same as the preferred embodiment described above. The distinguishing structure of this preferred embodiment is located in the forward end of the fuse holder 42 within the recesses 86 and 88. In the embodiment shown in FIG. 7, there are cylindrical or tubular receptors 170 affixed within the recesses 86 and 88 on the walls 96 such that the receptors 170 are centered on the axis of the fuses 44 and 46 when said fuses are in their fully inserted positions within the fuse holder 42. There is a rejection helical spring 172 with a forward positioning end 174 and a rear positioning end 176. Positioning holes 178 are located in wall 96 in a position within the inner radius of receptor 170 to allow insertion of the forward positioning end 174 of the spring 172 in said positioning hole 178 to fixedly maintain the spring 172 inside of the cylindrical receptor 170. A cylindrical rejection slide or member 180 is diametrically sized so that its outside diameter will allow a slidable telescopic reception of the slide 180 within the cylindrical receptor or member 170 and its inside diameter will allow slidable reception of the helical spring 172 within the rejection slide 180 with the end of 176 secured in the interior of the slide 180 as shown in FIG. 7. The inside diameter of the cylindrical rejection slide 180 further is sized to receive the turricular rejection post 113 and reject the larger diameter terminal portions 111 of the fuses 44. In this preferred embodiment, the fuse 44 is installed in the recesses 86 and 90 by inserting the post 113 into the rejection slide 180 and passing the fuse 44 through the opening between the sidewalls 94 of the associated recesses 86 and 90 to a position wherein the terminal 110 at one end of the fuse 44 is positioned against abutment 104 in the recess 90 and the turricular rejection post 113 of the terminal 111 is slidably telescoped within the cylindrical rejection slide 180. "A clearance between the outer wall of the rejection slide 180 and the receptor 170 permits the fuse 44 to be positioned with the rejection post 113 within the slie 180 before the terminal 110 is installed in the recess 90." The rejection helical spring 172 is compressed within the cylindrical rejection slide 180 between wall 96 and the turricular rejection post 113 of the terminal 111. During the passage of the terminals 110 and 111 to their respective positions within the recesses 90 and 86, the sidewalls 94 of the associated recesses 86 and 90 are flexed to permit the terminals 110 and 111 to pass over the nibs 106. Further with respect to terminal 111, prior to its passing over the nibs 106, the cylindrical rejection slide 180 is positioned in the receptor 170 and in a capping position over the turricular rejection post 113. When the slide 180 is in its retracted position helical spring 172 is positioned with its forward positioning portion 174 in the positioning hole 178 and its rear positioning portion 176 inside the cylindrical rejection slide 180 with the helical spring 172 and the slide 180 slightly transversely displaced from its axial orientation with respect to the fuse 44. As the terminal 111 passes over the nibs 106, the helical spring 172 as well as the slide approach an axial alignment with the fuse 44 in its rest position and the cylindrical rejection slide 180 is fully inserted within the cylindrical receptor 170. Upon final positioning of the fuse 44, the fuse 44 assumes the position described above. In event insertion of a standard fuse is attempted, the slide 180 will prevent insertion of the fuse to the assembled position.

Figure 2:
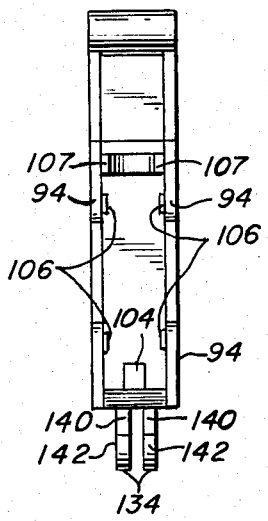
FIG. 2 is a side-view of the fuse holder in FIG. 1.
Figure 3:
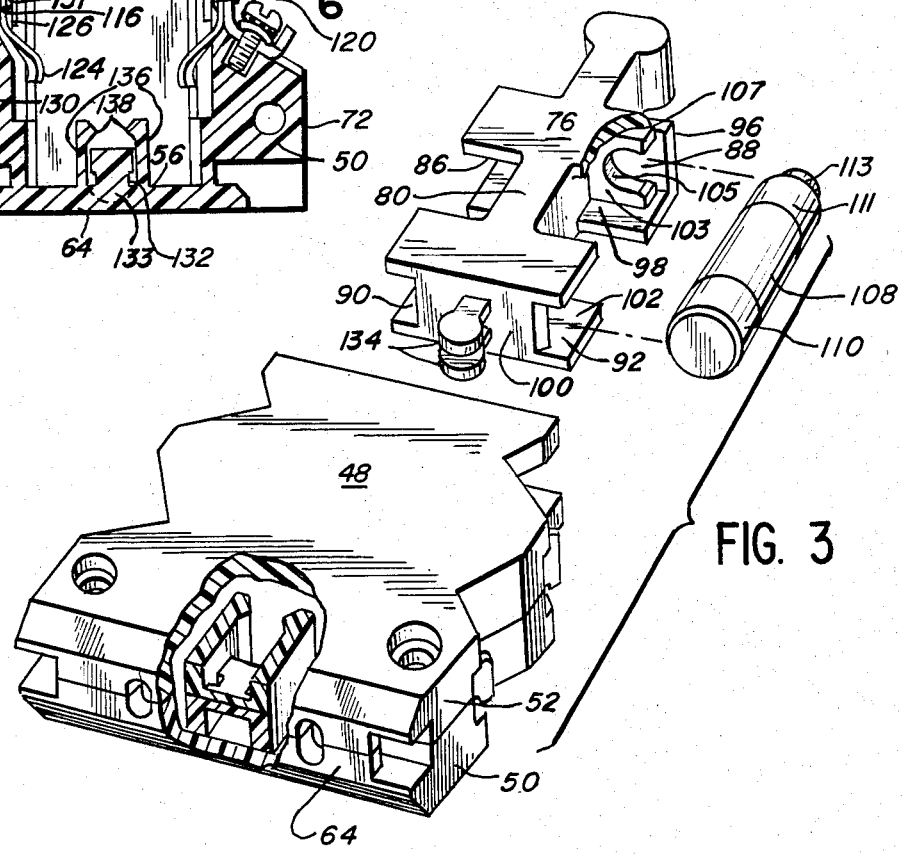
FIG. 3 is a perspective view of the fuse holder in FIG. 1 which more readily illustrates the cooperation of the various components of the invention.

The prior art with respect to this invention as disclosed in the Puetz Patent is illustrated in FIG. 8. FIG. 8A shows a partial perspective view of the rear portion of the fuse holder 42 to illustrate that prior art disclosed a single projection 184 from the rear of the fuse holder 42 where the present invention discloses twin projections 134, as shown in FIGS. 2 and 3. Further, the receptacle 40 of the prior art disclosed a socket 182 in its rear portion of the cavity 54 with no rejection plug 133 located therein which prevents a standard fuse holder without a rejection feature from being inserted in the rejection type receptacle.

While certain preferred embodiments of the invention have been specifically disclosed, it is understood that the invention is not limited thereto, as many variations will be readily apparent to those skilled in the art, and the invention is to be given its broadest possible interpretation within the terms of the following claims.

What we claim is:

1. An improved fuse holder system for a cartridge type fuse with a rejection feature, said fuse having a cylindrical body with terminals at opposite ends of said body, one of which has a turricular rejection post extending therefrom;

said fuse holder system having a receptacle formed of insulating parts to provide a socket substantially closed at its rear end and open at its front end and a fuse holder formed as a unitary part of insulating material of dimensions whereby said fuse holder is insertable within said socket;

said fuse holder having a means for positioning said fuse releasably therein and said fuse holder is suitably proportioned that, with said fuse releasably held therein, said fuse holder maybe inserted into said socket, said improvements comprising:

cradling means having a generally U-shaped cradle incorporated within one end of said fuse holder and serving as part of said means for positioning said fuse, and holding means having paired leg means at the rear of said fuse holder, a cavity at the rear of said socket formed by a pair of latching arms, and a rejection plug affixed centrally within said cavity for receiving said paired leg means astride said rejection plug when the latching arms engage the paired leg means which are astride the rejection plug;

whereby said cradling means will accept for positioning within said fuse holder only an end of said fuse having said turricular rejection post, and said holding means allow full insertion within said socket of only fuse holders having paired leg means appropriately dimensioned to fit within said cavity astride said rejection plug, the two said improvements thereby cooperating to insure that proper fuses, and only proper fuses, are capable of being employed in said fuse holder system.

2. A fuse holder system for a cartridge rejection type fuse with the fuse having a length and diameter provided by a cylindrical body and cylindrical metallic terminals at opposite ends of the body and including a rejection feature provided by a cylindrical metallic projection extending axially from an end of one of the cylindrical terminals with the cylindrical projection having a diameter smaller than its associated cylindrical terminal, said system comprising:

a receptacle providing a substantially rectangular socket extending between a substantially closed rear end and an open front end of the receptacle, and a fuse holder molded as a unitary part of insulating material and having a portion receivable in the socket with said portion including a cavity having a pair of insulating end walls and a pair of insulating side walls extending between each end wall with the side walls associated with one of the end walls engageable with the said one terminal to position and maintain a fuse having a rejection feature in the cavity and a fuse rejection feature including a rigid insulating portion molded integrally with the said one end wall sized and located to provide a path of such selected width as to allow passage therethrough of the cylindrical projection into a fully installed position but to exclude passage therethrough of one of said cylindrical terminals by reason of the greater diameter of the cylindrical terminal than that of the cylindrical projection.

3. The fuse holder system as recited in claim 2 including:

a cooperating means on the receptacle and fuse holder for permitting a fuse holder having a fuse rejection feature to be positioned in the socket and preventing a fuse holder without a fuse rejection feature from being positioned in the socket.

4. The fuse holder system as recited in claim 2 wherein the portion preventing passage of a fuse lacking a rejection feature is provided by a U-shaped cradle that is integral with its associated end wall and sized to receive a cylindrical projection of a rejection type fuse.

5. The fuse holder system as recited in claim 2 wherein the fuse holder has a pair of fuse receiving cavities facing in opposite directions and the fuse rejection feature is located at one end of each cavity with each fuse rejection feature including a U-shaped yoke extending from its associated end wall and arranged to permit passage of the cylindrical projection of the fuse having a rejection feature between sidewalls of the U-shaped yoke to a position adjacent a curved bight portion of the yoke.

6. The fuse holder system as recited in claim 2 wherein the receptacle includes a protuberance extending into the socket and the fuse holder includes means located to receive the protuberance when a fuse holder portion including a rejection feature is inserted into the socket and preventing a fuse holder portion without a rejection feature including a means to receive the protuberance from being inserted into the socket.

7. A fuse holder system for a cartridge type fuse with the fuse having a length and diameter provided by a cylindrical body and cylindrical terminals at opposite ends of the body and including a rejection feature provided by a cylindrical projection extending axially from an end of one of the cylindrical terminals with the cylindrical projection having a diameter smaller than its associated terminal, said system comprising a receptacle providing a substantially rectangular socket extending between a substantially closed rear end and an open front end of the receptacle and a fuse holder having a portion receivable in the socket with said portion including a cavity having a pair of end walls spaced to axially position a fuse having a rejection feature in the cavity with each end wall extending between a pair of side walls of the cavity and wherein the rejection feature includes a spring and a member biased by the spring and extending a predetermined distance from one of the end walls, said member having an open end portion having an internal diameter sized to receive the cylindrical projection when a fuse having a rejection feature is positioned in the cavity with the member extending from its associated end wall and the internal diameter of the end portion sized to exclude passage of one of said cylindrical terminals into the open end and into the cavity by reason of the greater diameter of the cylindrical terminals than that of the cylindrical projection.

8. The fuse holder system as recited in claim 7 wherein the spring biased member is slidably received in a tubular member that has an end secured to the fuse holder.

* * * * *